US010654284B2

(12) United States Patent
Teo et al.

(10) Patent No.: US 10,654,284 B2
(45) Date of Patent: May 19, 2020

(54) FLUID STORAGE DEVICE WITH MULTI-POSITION SEAL ASSEMBLY

(71) Applicant: HEWLETT-PACKARD DEVELOPMENT COMPANY, L.P., Houston, TX (US)

(72) Inventors: Cherng Linn Teo, Singapore (SG); Kelvin Chiew, Singapore (SG); Tian Cheng Tang, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/091,291

(22) PCT Filed: Apr. 19, 2016

(86) PCT No.: PCT/US2016/028244
§ 371 (c)(1),
(2) Date: Oct. 4, 2018

(87) PCT Pub. No.: WO2017/184118
PCT Pub. Date: Oct. 26, 2017

(65) Prior Publication Data

US 2019/0118547 A1 Apr. 25, 2019

(51) Int. Cl.
*B41J 2/19* (2006.01)
*B41J 2/175* (2006.01)

(52) U.S. Cl.
CPC ..... *B41J 2/19* (2013.01); *B41J 2/17506* (2013.01); *B41J 2/17513* (2013.01); *B41J 2/17523* (2013.01); *B41J 2/17553* (2013.01); *B41J 2/17559* (2013.01)

(58) Field of Classification Search
CPC ..... B41J 2/17513; B41J 2/17506; B41J 2/17509; B41J 2/17596; B41J 2/305
See application file for complete search history.

(56) References Cited

U.S. PATENT DOCUMENTS

| | | | | |
|---|---|---|---|---|
| 5,555,007 | A | 9/1996 | Ceschin et al. | |
| 5,581,287 | A | 12/1996 | Baezner et al. | |
| 5,659,347 | A * | 8/1997 | Taylor | B41J 2/17596 137/625.41 |
| 5,838,352 | A | 11/1998 | Martinez | |
| 6,012,808 | A * | 1/2000 | Koitabashi | B41J 2/17506 347/86 |
| 6,095,643 | A | 8/2000 | Cook | |
| 6,247,803 | B1 | 6/2001 | Kanaya et al. | |
| 6,257,714 | B1 * | 7/2001 | Seccombe | B41J 2/16532 347/92 |

(Continued)

OTHER PUBLICATIONS

Refilling the Ink Tanks; retrieved from the web Feb. 26, 2016; https://files.support.epson.com/docid/cpd4/cpd42914/source/printers/source/ink_functions/tasks/et2550_I475/refilling_in_k_tanks_et2550_I475.html.

*Primary Examiner* — John Zimmermann
(74) *Attorney, Agent, or Firm* — Fabian VanCott

(57) ABSTRACT

In one example in accordance with the present disclosure a fluid storage device is described. The device includes a fluid reservoir to store fluid. The fluid reservoir includes a free fluid chamber and an overflow chamber in fluid communication with the free fluid chamber. The reservoir also includes a seal assembly to, when in a first position, seal a refill port of the free fluid chamber and open an air vent of the overflow chamber. When in a second position, the seal assembly opens the refill port and seals the air vent.

20 Claims, 7 Drawing Sheets

(56) References Cited

U.S. PATENT DOCUMENTS

| | | | | |
|---|---|---|---|---|
| 6,474,796 | B1 | 11/2002 | Ishinaga | |
| 6,733,115 | B2 | 5/2004 | Santhamam | |
| 6,908,180 | B2 | 3/2005 | Dietl | |
| 7,445,323 | B2 | 11/2008 | Anderson et al. | |
| 8,480,216 | B2 * | 7/2013 | Matsumoto | B41J 2/16523 347/85 |
| 2002/0063759 | A1 * | 5/2002 | Hirano | B41J 2/17503 347/85 |
| 2010/0079516 | A1 * | 4/2010 | Nakazawa | B41J 2/17596 347/7 |
| 2010/0289856 | A1 * | 11/2010 | Yamamoto | B41J 2/17509 347/85 |
| 2012/0145713 | A1 * | 6/2012 | Jung | A47J 41/0011 220/254.3 |
| 2016/0297583 | A1 * | 10/2016 | Staeben | F21V 33/004 |
| 2017/0253397 | A1 * | 9/2017 | Coon | A47G 19/2272 |

* cited by examiner

FLUID STORAGE DEVICE WITH MULTI-POSITION SEAL ASSEMBLY

BACKGROUND

Fluid reservoirs are used to contain all sorts of fluids. For example in printing systems, print cartridges hold stores of printing fluid such as ink. In one example, the ink, or other printing fluid from a reservoir, is supplied to a printhead which deposits the printing fluid onto a print medium, such as paper. As the fluid reservoir can hold a finite amount of fluid, the fluid in a reservoir may be refilled, or the entire reservoir be replaced.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
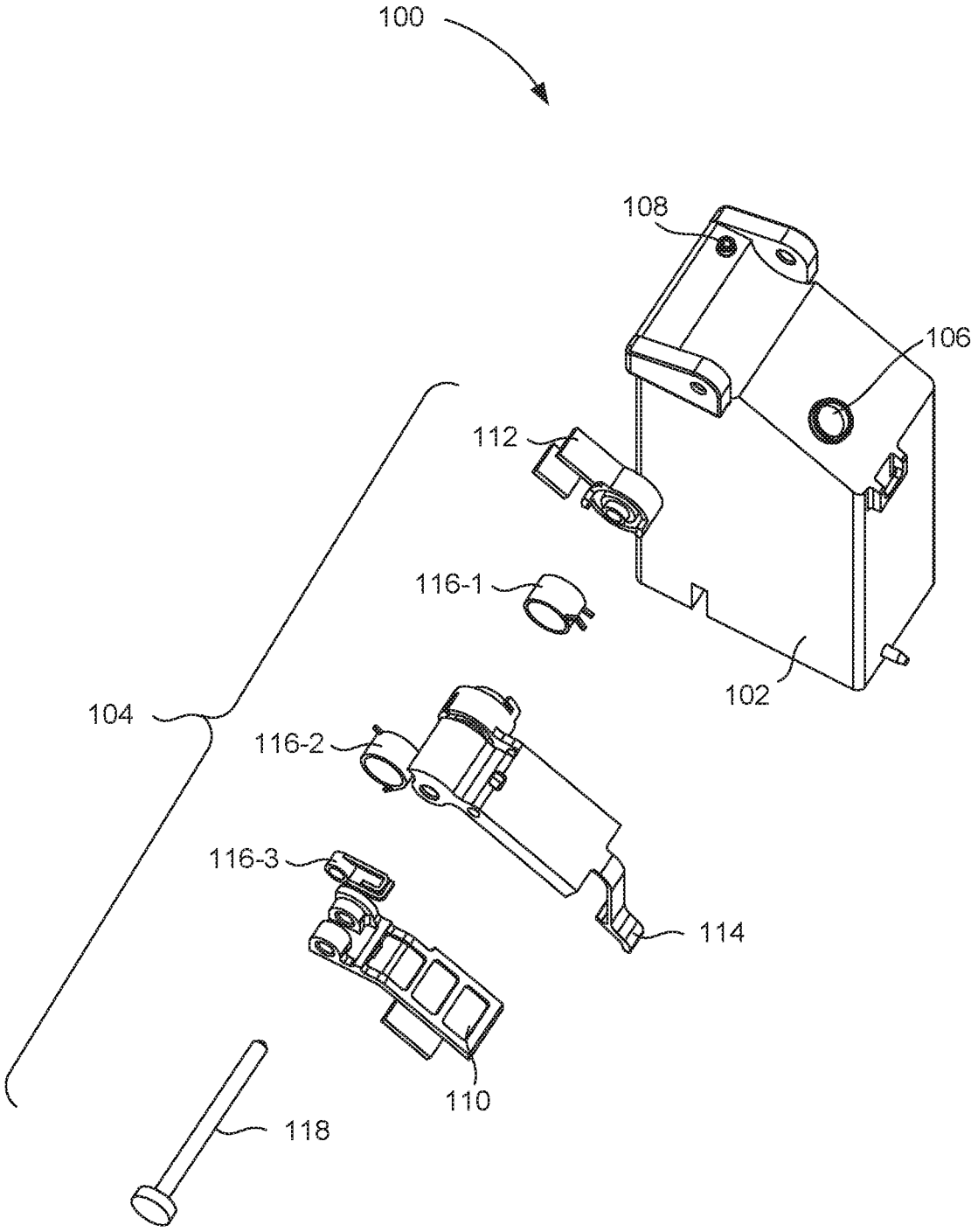
FIG. 1 is an exploded isometric view of a fluid storage device with a multi-position seal assembly, according to an example of the principles described herein.

Fluid storage devices are used to hold various types of fluids. For example, in a printing system, an ink cartridge stores a volume of ink. This ink is passed to a printhead for ultimate deposition on a print media to form texts or images on the print media.

Many fluid storage devices include an overflow chamber in addition to a fluid chamber. The overflow chamber has various functions. As a specific example, a printhead includes nozzles to eject printing fluid onto a print medium. These nozzles may face downward and the print medium passes under the nozzles. As the printhead nozzles face down, the printing fluid has a tendency to leak out of the nozzles due to the effects of gravity. The printing fluid is prevented from dripping out the nozzles due to a backpressure. The backpressure is not large enough to prevent fluid flow during printing, but large enough to prevent fluid flow when an associated printing device is idle. The backpressure is generated due to a height difference between the position of the nozzles, and a position of an opening between an overflow chamber of the fluid storage device and a fluid chamber.

In order to prevent fluid from leaking out of the free fluid chamber, a negative pressure may exist within the free fluid chamber. This negative pressure inside the free fluid chamber is related to a weight of the fluid inside the free fluid chamber pulling on the air inside the free fluid chamber. When there is more fluid in the free fluid chamber, this negative pressure exerted by the fluid weight on the air inside the free fluid chamber is greater than when there is less fluid in the free fluid chamber. In one example, a pressure that prevents printing fluid from dripping out the nozzles of a printhead is referred to as a back pressure, and a pressure within a free fluid chamber that retains the fluid therein is referred to as a negative pressure.

As printing fluid is used, the level of printing fluid in the free fluid chamber decreases. If an opening connecting the free fluid chamber and an overflow chamber is closed, then the negative pressure in the free fluid chamber will act as a system backpressure and the backpressure will increase.

Returning to the overflow chamber, over time as environmental conditions—such as temperature and pressure—change, the fluid in the free fluid chamber may be forced out of the free fluid chamber due to expansion of air within the free fluid chamber. The overflow chamber, functions to retain this overflow fluid, which is stored for later use.

While such systems are valuable in their ability to deliver fluid, such as ink, to a system, such as a printing system; some characteristics complicate their use. For example, as the free fluid chamber is to be sealed during operation, it is difficult to refill such fluid storage devices. Moreover, it is desirable to ensure that little or no fluid overflows into the overflow chamber during refill. Any fluid that does overflow into the overflow chamber, such that the overflow chamber fluid level reaches a height above the opening between the overflow chamber and the free fluid chamber, will reduce the system backpressure as the backpressure is now measured between the height of the nozzles of the printhead and the height of the fluid in the overflow chamber. Accordingly, the present specification describes a device and methods for refilling a fluid storage device while preventing unnecessary flow of fluid to the overflow chamber. During printing however, the overflow chamber captures whatever fluid overflows into it during operation.

Specifically, the present specification describes a fluid storage device. The fluid storage device includes a fluid reservoir to store fluid. The fluid reservoir is divided into a free fluid chamber and an overflow chamber that is in fluid communication with the free fluid chamber. A seal assembly of the fluid reservoir seals a refill port of the free fluid chamber and opens an air vent of the overflow chamber when in a first position. The seal assembly opens the refill port and seals the air vent when in a second position.

Still further, the present specification describes a method for manufacturing a fluid storage device. A seal assembly is obtained, which seal assembly includes a refill port cover to cover a refill port of a free fluid chamber of a fluid reservoir when the seal assembly is in a first position and an intermediate position. An air vent cover of the seal assembly covers an air vent in an overflow chamber of the fluid reservoir when the seal assembly is in an intermediate position and a second position. The seal assembly also includes an actuator to move the seal assembly between the first position, intermediate position, and second position. The seal assembly is rotationally coupled to the fluid reservoir such that via a single movement, the seal assembly rotates through the first position, the intermediate position, and the second position.

The present specification further describes a fluid storage device that includes a printing fluid reservoir. The printing fluid reservoir includes a free fluid chamber to supply a printhead with printing fluid. The free fluid chamber has a refill port through which the free fluid chamber is refilled with the printing fluid. The printing fluid reservoir also includes an overflow chamber in fluid communication with the free fluid chamber. The overflow chamber has an air vent. The printing fluid reservoir also includes a seal assembly to selectively seal at least one of the free fluid chamber and the overflow chamber. When the seal assembly is in a first position, the air vent in the overflow chamber is open and the refill port in the free fluid chamber is sealed. When the seal assembly is in an intermediate position, the air vent in the overflow chamber is sealed and the refill port in the free fluid chamber is also sealed. When the seal assembly is in a second position, the air vent in the overflow chamber is sealed and the refill port in the free fluid chamber is open.

Such a fluid storage device 1) maintains a constant negative pressure in the free fluid chamber, even as fluid is being dispersed from the free fluid chamber; 2) allows for refilling of the free fluid chamber, while sealing the overflow chamber such that fluid doesn't unnecessarily drain into the overflow chamber; and 3) improves the simplicity and efficiency of fluid reservoir refilling. However, it is contemplated that the devices disclosed herein may provide useful in addressing other matters and deficiencies in a number of technical areas. Therefore the systems and methods disclosed herein should not be construed as addressing any of the particular matters.

As used in the present specification, and in the appended claims, the term "stable" indicates that the seal assembly remains in a given position without continual force by a user. When not in a stable position, the seal assembly will bias towards a stable position.

As used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language indicates that a particular feature, structure, or characteristic described in connection with that example is included as described, but may not be included in other examples.

Turning now to the figures, FIG. 1 is an exploded isometric view of a fluid storage device (100) with a multi-position seal assembly (104), according to one example of the principles described herein. The fluid storage device (100) includes a fluid reservoir (102) that is a receptacle of fluid. For example, the fluid disposed therein may be ink, in which case, the fluid reservoir (102) is an ink reservoir. In this example, the fluid storage device (100) may be insertable into a printing device and serves as a reservoir of ink that is ultimately ejected onto a print medium to form images and/or text on the print medium.

The fluid reservoir (102) may be refillable. More specifically, a free fluid chamber in the fluid reservoir (102), which free fluid chamber includes an outlet that supplies the fluid to the system, may be refillable with fluid. Accordingly, the fluid reservoir (102) includes a refill port (106) through which fluid is added to the free fluid chamber. During printing, this refill port (106) is to remain closed so that a negative pressure can be maintained within the free fluid chamber to support the weight of the fluid inside the free fluid chamber.

To store fluid that is forced out of the free fluid chamber, due for example to changes in environmental conditions, the fluid reservoir (102) includes an overflow chamber. The overflow chamber includes an air vent (108) that allows fluid to enter and exit the overflow chamber. During printing this air vent (108) is open to allow overflow fluid to flow freely between the overflow chamber and the free fluid chamber.

However, during refilling of the free fluid chamber, this air vent (108) may be closed such that fluid doesn't flow into the overflow chamber during refilling. In other words, during refilling with this air vent (108) closed, the overflow chamber is a closed volume to prevent fluid entry into the overflow chamber. If fluid were allowed to flow into the overflow chamber during refilling, air would be forced out the air vent (108) and refilled fluid would occupy a greater space within the overflow chamber. If the fluid in the overflow chamber reaches a level above the opening between the free fluid chamber and the overflow chamber, then the system backpressure may be reduced as the backpressure will now be defined by the head height difference between the nozzles of the printhead and the fluid in the overflow chamber. There would also be less negative space in the overflow chamber for excess fluid to flow.

The fluid storage device (100) also includes a seal assembly (104). The seal assembly (104) sequentially opens and closes the refill port (106) and the air vent (108) at different stages of operation so as to facilitate both printing and refilling the fluid reservoir (102). Specifically, the seal assembly (104) includes a refill port cover (110). During printing, the seal assembly (104) is positioned such that this refill port cover (110) is disposed over, and covers the refill port (106). Covering the refill port (106) allows a negative pressure to exist in the free fluid chamber, rather than exposing the free fluid chamber to atmospheric pressure. The refill port cover (110) may include an elastomer seal to seal the refill port (106). During refilling, the refill port cover (110) is removed from the refill port (106) via the actuator (114). In so doing, the refill port (106) is exposed to allow the free fluid chamber to be filled with fluid.

The seal assembly (104) also includes an air vent cover (112). During printing, the seal assembly (104) is positioned such that this air vent cover (112) is open, thus allowing free flow of fluid and air between the overflow chamber and the free fluid chamber. The air vent cover (112) may similarly include an elastomer to cover and seal the air vent (108). During refilling, the air vent cover (112) covers the air vent (108) so as to create a closed volume, thus preventing the overfilling of the fluid reservoir (102). In other words, during operation, the fluid reservoir (102) uses unoccupied space in the overflow chamber so as to allow for the temporary storage of overflow fluid. Accordingly, the overflow chamber will capture whatever fluid overflows from the free fluid chamber and prevent any spillage, which spillage may result in wasted fluid as well as customer dissatisfaction with the associated mess.

As will be demonstrated below, the seal assembly (104) may be in an intermediate position wherein both the refill port cover (110) and the air vent cover (112) cover and seal the refill port (106) and air vent (108), respectively.

In some examples, the seal assembly (104) includes a number of springs (116-1, 116-2, 116-3) that bias the seal assembly (104) in any of these positions. In other words, the seal assembly (104) is stable when in the first position, the intermediate position, or the second position such that the seal assembly (104) remains in these positions without continual force by a user. When not in one of the designated positions, the springs may bias the seal assembly (104) towards one of the designated positions.

The seal assembly (104) also includes a shaft (118) to allow the seal assembly (104) to be rotationally coupled to the fluid reservoir (102). Note that while specific reference is made to a door-type seal assembly (104) that rotates, any device may be used that selectively and sequentially opens and closes the refill port (106) and the air vent (108). For example, electrical control devices could be used to open and close these openings.

Figure 2A:
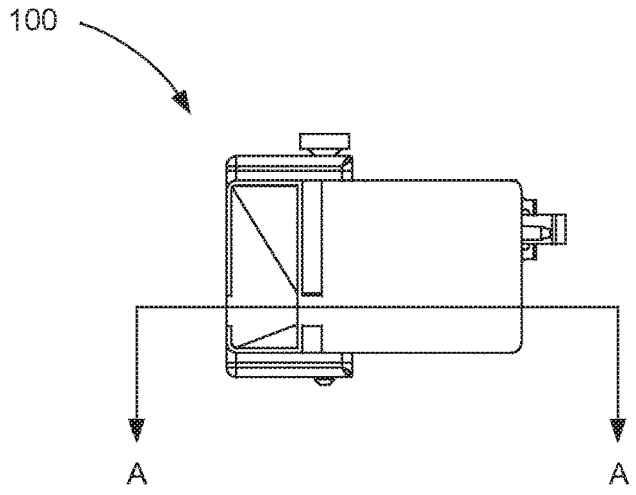
FIGS. 2A and 2B are views of the fluid storage device with a multi-position seal assembly, according to an example of the principles described herein.
Figure 2B:
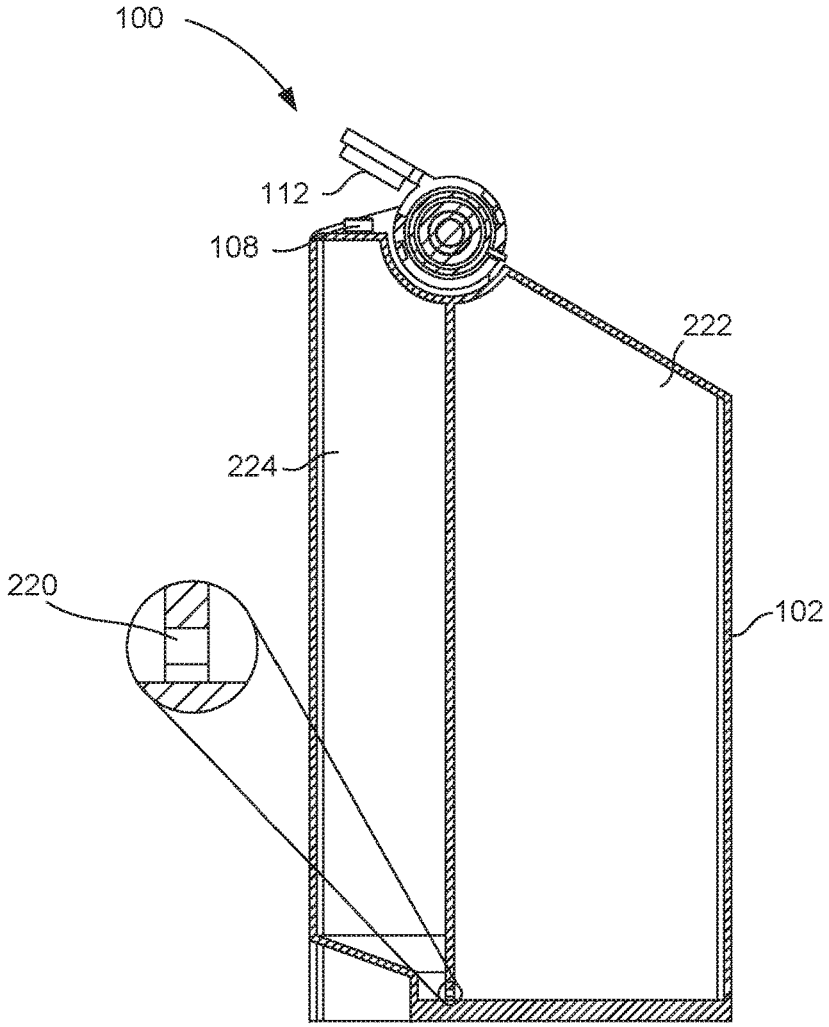

FIGS. 2A and 2B are views of the fluid storage device (100) with a multi-position seal assembly (FIG. 1, 104). Specifically, FIG. 2A is a bottom view of the fluid storage device (100), and FIG. 2B is a cross-sectional view of the fluid storage device (100) taken along the line A-A in FIG. 2A. As described above, the fluid reservoir (102) includes a free fluid chamber (222) and an overflow chamber (224). The free fluid chamber (222) holds fluid that is output via a supply line to the system. For example, in a printing system, the free fluid chamber (222), via the supply line, supplies a printhead with printing fluid.

The overflow chamber (224) is in fluid communication with the free fluid chamber (222), for example via the opening (220) at the base of the two chambers. One purpose of the overflow chamber (224) is to provide a chamber to hold fluid that inevitably overflows from the free fluid chamber (222) due to environmental changes, i.e., temperature and pressure. Specifically, increases in temperature and/or decreases in pressure in the environment may cause the air in the free fluid chamber (222) to expand. Such expansion of air inside the free fluid chamber (222) pushes fluid down and through the opening (220) to the overflow chamber (224). Without an overflow chamber (224), such temperature and pressure changes could push the fluid out of the reservoir (102) and onto other components, such as components of the printing system in which the reservoir (102) is installed, or onto a surface such as a user's skin, clothes, or working surface. Such spillage is undesirable as it results in wasted printing fluid and may result in customer dissatisfaction due to the spilled fluids effects on other components or the general mess created therein.

Also through the opening (220), air may flow to maintain the negative pressure within the free fluid chamber (222). For example, as the free fluid chamber (222) is depleted of fluid, the negative pressure increases. The air vent (108) in the overflow chamber (224) allows air to enter the fluid reservoir (102) and to be selectively passed to the free fluid chamber (222) to maintain the desired negative pressure within the free fluid chamber (222). As described above, the seal assembly (104) selectively seals at least one of the free fluid chamber (222) and the overflow chamber (224). FIGS. 3A-5C illustrate the operation of the seal assembly (104).

Figure 3A:
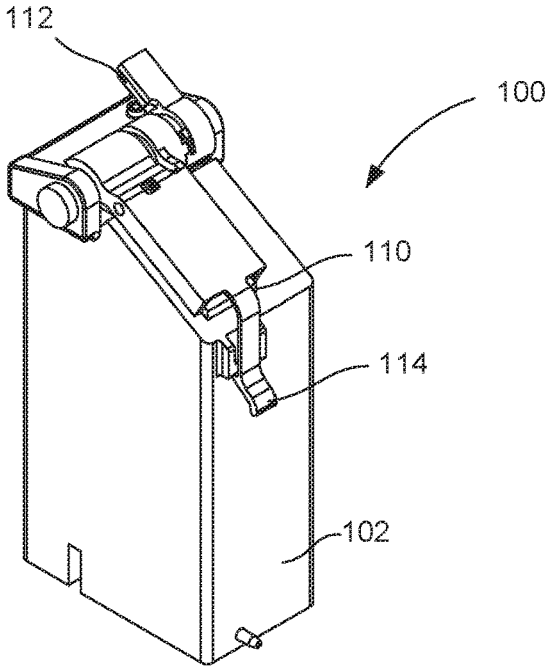
FIG. 3A-3C are views of the fluid storage device with the seal assembly in a first position, according to an example of the principles described herein.
Figure 3B:
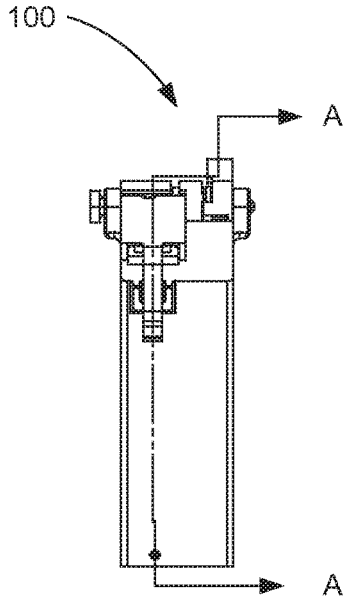
Figure 3C:
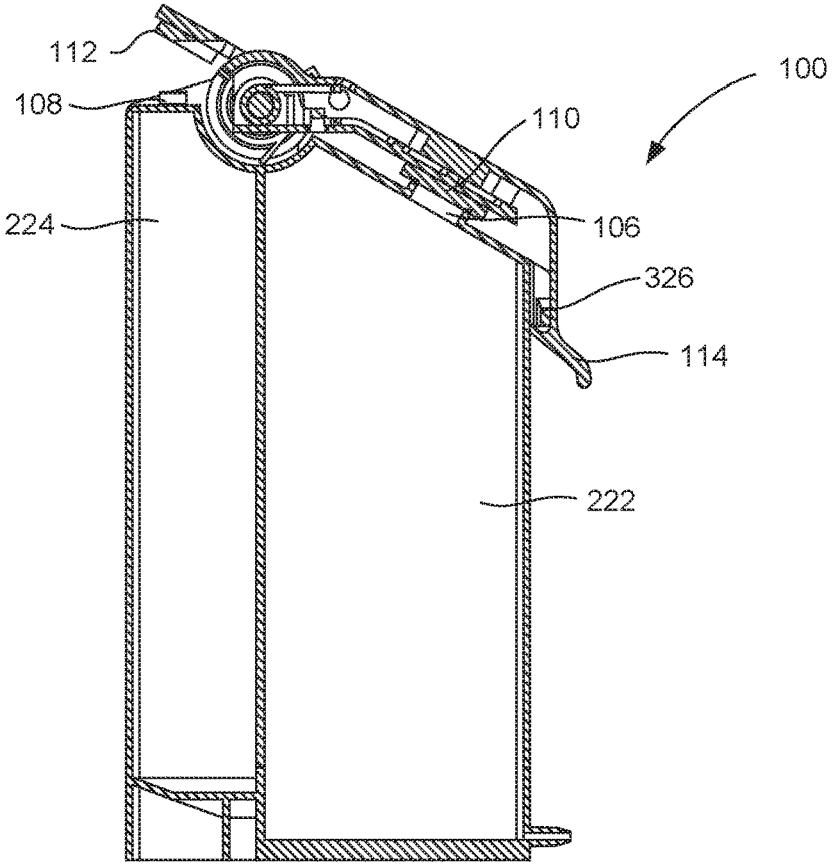

Specifically, FIG. 3A-3C are views of the fluid storage device (100) with the multi-position seal assembly (FIG. 1, 104) in a first position, according to one example of the principles described herein. Specifically, FIG. 3A is an isometric view of the fluid storage device (100) with the seal assembly (FIG. 1, 104) in a first position, FIG. 3B is a front view of the fluid storage device (100) with the seal assembly (FIG. 1, 104) in a first position, and FIG. 3C is a cross sectional view of the fluid storage device (100) taken along the line A-A in FIG. 3B. In the first position, fluid may be supplied to a printhead. In other words, the seal assembly (FIG. 1, 104) may be in the first position while printing fluid is being deposited on a print media. In this first position, the refill port cover (110) covers the refill port (106) so as to maintain a desired negative pressure in the free fluid chamber (222). Still further, when the seal assembly (FIG. 1, 104) is in the first position, the air vent cover (112) is positioned such that the air vent (108) is open to allow the free flow of fluid between the overflow chamber (224) and the free fluid chamber (222). In other words, when the seal assembly (FIG. 1, 104) is in the first position, a negative pressure is maintained in the free fluid chamber (222) and fluid and air can readily pass through the opening (FIG. 2, 220) between the overflow chamber (224) and the free fluid chamber (222).

Note that in some examples, the actuator (114) of the seal assembly (FIG. 1, 104), or the seal assembly (FIG. 1, 104) itself in general, is flush against the fluid reservoir (102) when the seal assembly (FIG. 1, 104) is in the first position. Doing so may reduce the size of the fluid storage device (100) in the first position, such that it can fit in smaller spaces, for example, a closed printing device.

In some examples, the fluid storage device (100) includes a retention mechanism (326) disposed on the fluid reservoir (102) to mate with the seal assembly (FIG. 1, 104) when in the first position. While FIGS. 3A-3C depict a latch, the retention mechanism (326) may be any component that retains the seal assembly (FIG. 1, 104) against the body of the fluid reservoir (102). In so doing, the retention mechanism (326) protects against any inadvertent movement of the seal assembly (FIG. 1, 104), and correspondingly, any unwanted venting of the refill port (106), for example during a printing operation.

Figure 4A:
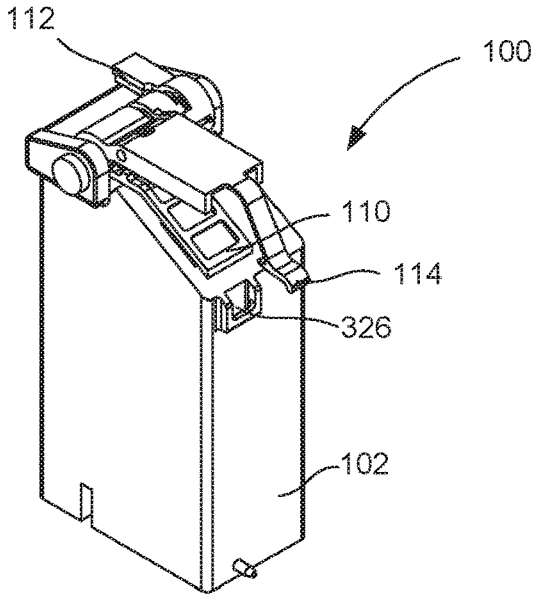
FIG. 4A-4C are views of the fluid storage device with the seal assembly in an intermediate position, according to an example of the principles described herein.
Figure 4B:
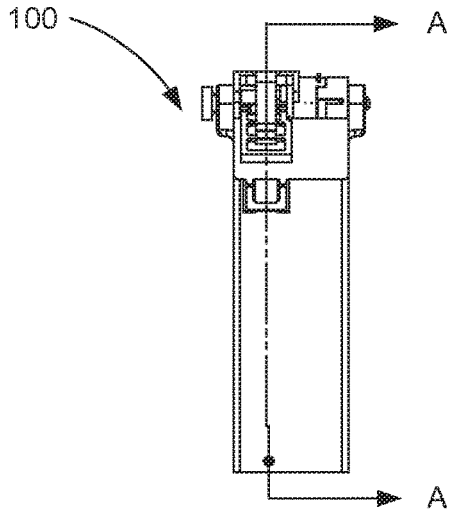
Figure 4C:
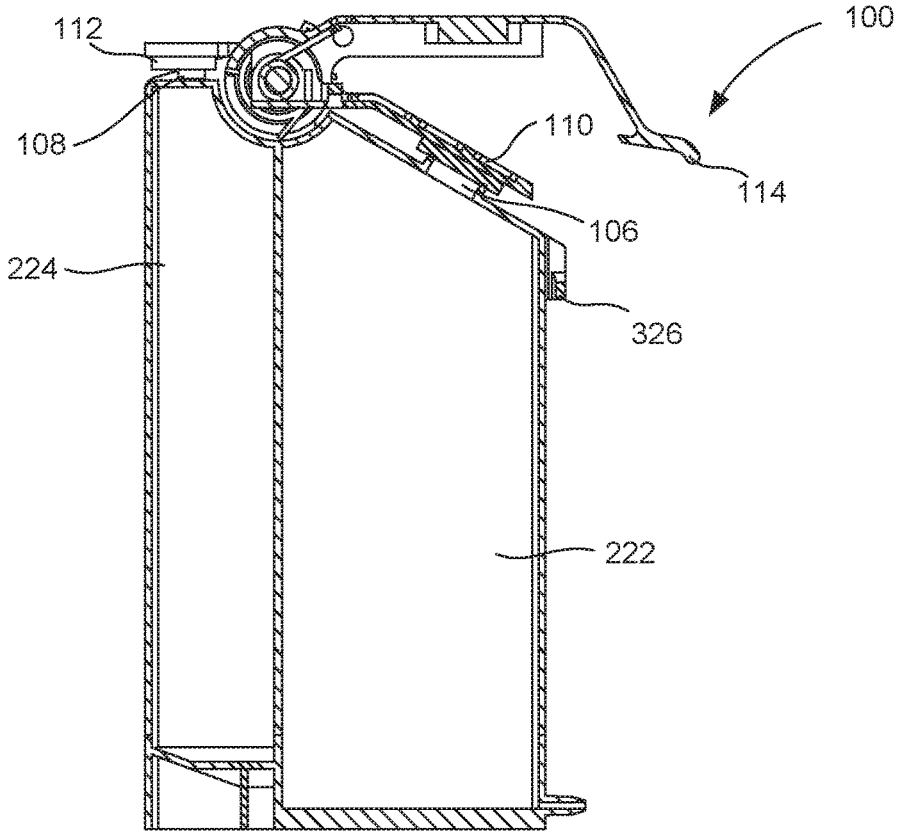

FIG. 4A-4C are views of the fluid storage device (100) with the multi-position seal assembly (FIG. 1, 104) in an intermediate position, according to one example of the principles described herein. Specifically, FIG. 4A is an isometric view of the fluid storage device (100) with the seal assembly (FIG. 1, 104) in an intermediate position, FIG. 4B is a front view of the fluid storage device (100) with the seal assembly (FIG. 1, 104) in an intermediate position, and FIG. 4C is a cross sectional view of the fluid storage device (100) taken along the line A-A in FIG. 4B. The intermediate position is between the first position and the second position wherein the seal assembly (FIG. 1, 104) seals the refill port (106) of the free fluid chamber (222) and seals the air vent (108) of the overflow chamber (224). The seal assembly (FIG. 1, 104) may be in this intermediate position while transitioning between a phase where printing fluid is deposited on the print media and printing fluid is refilled into the free fluid chamber (222). Having such an intermediate position ensures that the proper chambers are sealed at appropriate times, i.e., that there is not a time when both the refill port (106) and the air vent (108) are both exposed to atmospheric pressure.

In the intermediate position, both the refill port cover (110) and the air vent cover (112) cover their respective openings. Note that when the seal assembly (FIG. 1, 104) is in the first position as depicted in FIGS. 3A-3C and in the intermediate position as depicted in FIGS. 4A-4C, the refill port cover (110) covers the refill port (106).

Figure 5A:
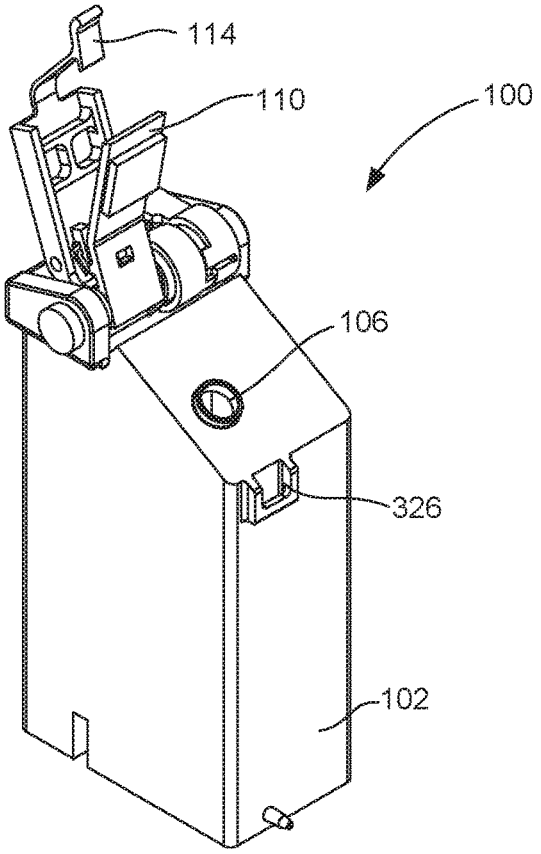
FIGS. 5A-5C are views of the fluid storage device with the seal assembly in a second position, according to an example of the principles described herein.
Figure 5B:
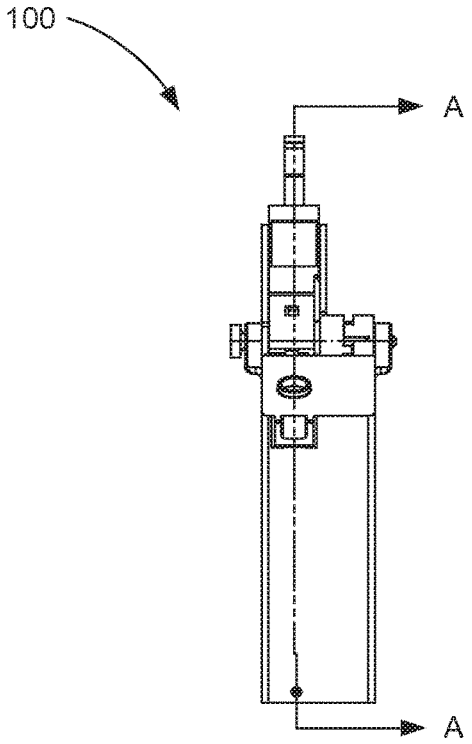
Figure 5C:
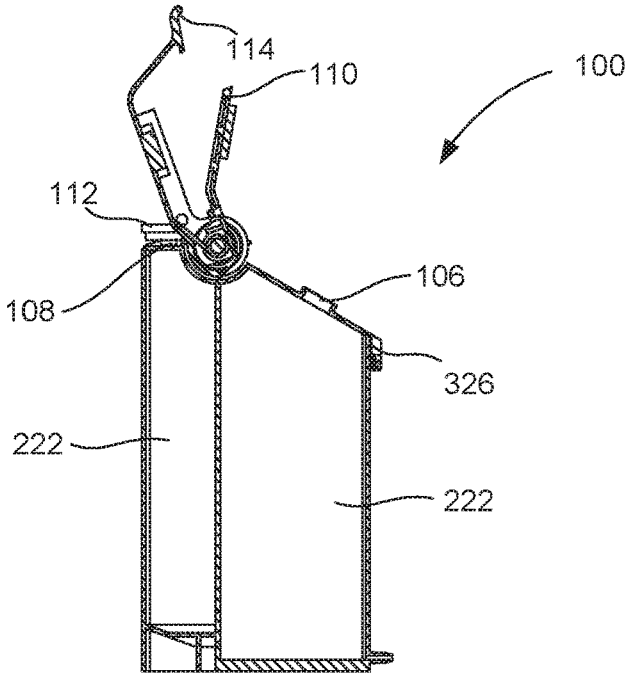

FIGS. 5A-5C are views of the fluid storage device (100) with the multi-position seal assembly (FIG. 1, 104) in a second position, according to one example of the principles described herein. Specifically, FIG. 5A is an isometric view of the fluid storage device (100) with the seal assembly (FIG. 1, 104) in a second position, FIG. 5B is a front view of the fluid storage device (100) with the seal assembly (FIG. 1, 104) in a second position, and FIG. 5C is a cross sectional view of the fluid storage device (100) taken along the line A-A in FIG. 5B. When the seal assembly (FIG. 1, 104) is in the second position, the free fluid chamber (222) of the fluid reservoir (102) may be refilled with printing fluid. In this second position, the refill port (106) is open such that fluid may be filled into the free fluid chamber (222). The air vent (108) is covered by the air vent cover (112) to provide an enclosed volume in the overflow chamber (224). The overflow chamber (224) is enclosed during refilling so that no refilled fluid passes into the overflow chamber (224). Were fluid to pass into the overflow chamber (224) during refilling, the overflow chamber (224) may become overfilled with printing fluid and there may be no available space, or less available space for overflow fluid to go when the printing device is in an idle state.

Note that when the seal assembly (FIG. 1, 104) is in the second position as depicted in FIGS. 5A-5C and in the intermediate position as depicted in FIGS. 4A-4C, the air vent cover (112) covers the air vent (108).

The seal assembly (FIG. 1, 104) rotates through the first position depicted in FIGS. 3A-3C, through the intermediate position depicted in FIGS. 4A-4C, and to the second position depicted in FIGS. 5A-5C, via a single movement. For example, as depicted in FIGS. 3A-5C, the seal assembly (104) rotates about the longitudinal axis of the shaft (FIG. 1, 118) in a single motion. When traveling in an opposite direction, i.e., from the second position, through the intermediate position, to the first position, the seal assembly (FIG. 1, 104) similarly travels in a single motion, i.e., rotation about the shaft (FIG. 1, 118). While specific reference is made to a rotational motion to change the position of the seal assembly (FIG. 1, 104), any motion may be used herein including for example, translation of the covers (FIG. 1, 110, 112).

Figure 6:
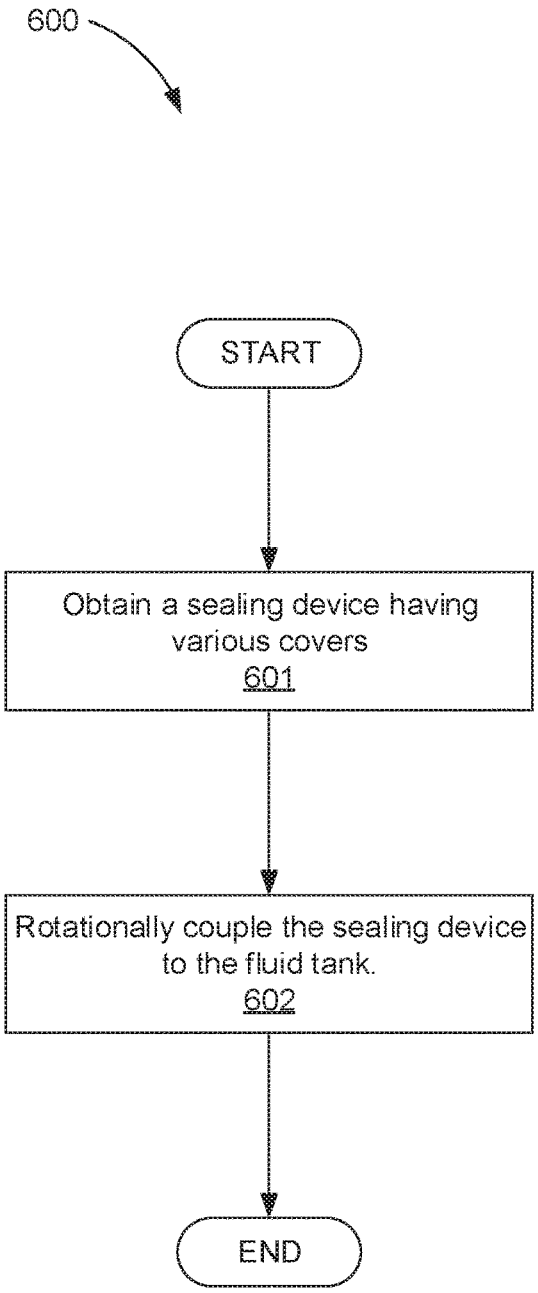
FIG. 6 is a flow chart of a method for manufacturing a fluid storage device with a multi-position seal assembly, according to an example of the principles described herein.

FIG. 6 is a flowchart of a method (600) for manufacturing a fluid storage device (FIG. 1, 100) with a multi-position seal assembly (FIG. 1, 104), according to one example of the principles described herein. According to the method (600), a seal assembly (FIG. 1, 104) is obtained (block 601). The seal assembly (FIG. 1, 104) has multiple components. Specifically, the seal assembly (FIG. 1, 104) includes a refill port cover (FIG. 1, 110) that covers a refill port (FIG. 1, 106) of the free fluid chamber (FIG. 2, 222) in at least a first position and an intermediate position. More specifically, the refill port (FIG. 1, 106) is closed during printing to prevent atmospheric venting and to maintain a negative pressure inside the free fluid chamber (FIG. 2, 222). The refill port (FIG. 1, 106) is also closed during a transition between printing and refilling. When in a refilling stage, the refill port (FIG. 1, 106) is open such that fluid can be added to the free fluid chamber (FIG. 2, 222).

The seal assembly (FIG. 1, 104) also includes an air vent cover (FIG. 1, 112) to cover an air vent (FIG. 1, 108) during various phases. Specifically, the air vent cover (FIG. 1, 112) covers an air vent (FIG. 1, 108) during the intermediate phase and during a second phase, i.e., a refilling phase. The air vent (FIG. 1, 108) is covered during the refilling phase to form an enclosed volume into which refilled fluid cannot pass during refilling. This enclosed volume preserves air space within the overflow chamber (FIG. 2, 224) such that whenever there is a raise of temperature or decrease in pressure in the environment, any fluid which overflows from the free fluid camber (FIG. 2, 222) can be captured in the overflow chamber (FIG. 2, 224).

The seal assembly (FIG. 1, 104) also includes an actuator that shifts the position of the air vent cover (FIG. 1, 112) and the refill port cover (FIG. 1, 110). For example, the actuator may be a latch (FIG. 1, 114) that via a single motion, i.e., a single rotational motion, moves the seal assembly (FIG. 1, 104) from the first position, through the intermediate position, and into the second position. Accordingly, the seal assembly (FIG. 1, 104) is rotationally coupled (block 602) to the fluid reservoir (FIG. 1, 102) such that via a single movement, the seal assembly (FIG. 1, 104) rotates through the first position, the intermediate position, and towards the second position. A similar motion, but in the reverse direction, i.e., a rotation in the opposite direction, moves the seal assembly (FIG. 1, 104) from the second position, through the intermediate position, and into the first position.

While the accompanying description describes a door-type seal assembly (FIG. 1, 104) that rotates, the present specification can be implemented with other types of seal assemblies that allow for the selective progression through a printing phase, wherein the air vent (FIG. 1, 108) is opened and the refill port (FIG. 1, 106) is sealed, through an intermediate phase where both openings are closed, and to a refilling phase, wherein the air vent (FIG. 1, 108) is closed and the refill port (FIG. 1, 106) is open.

As described above, the seal assembly (FIG. 1, 104) includes a number of springs, and accordingly is spring-loaded. Doing so biases the seal assembly (FIG. 1, 104) to the various positions. That is, the seal assembly (FIG. 1, 104) will bias towards the different positions and not be stable when between the positions described herein.

Figure 7A:
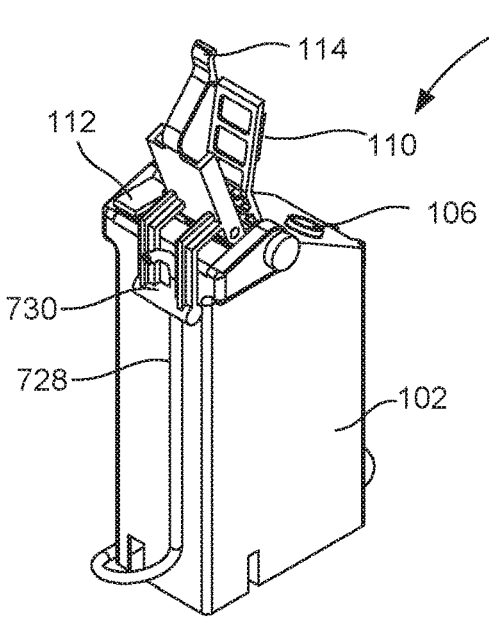
FIGS. 7A-7C are diagrams of a fluid storage device with a multi-position seal assembly, according to another example of the principles described herein.
Figure 7B:
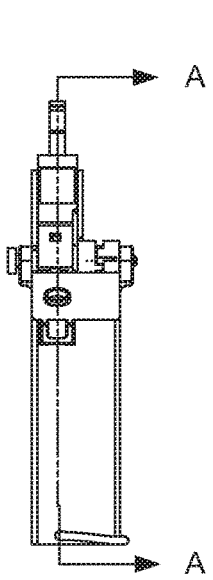
Figure 7C:
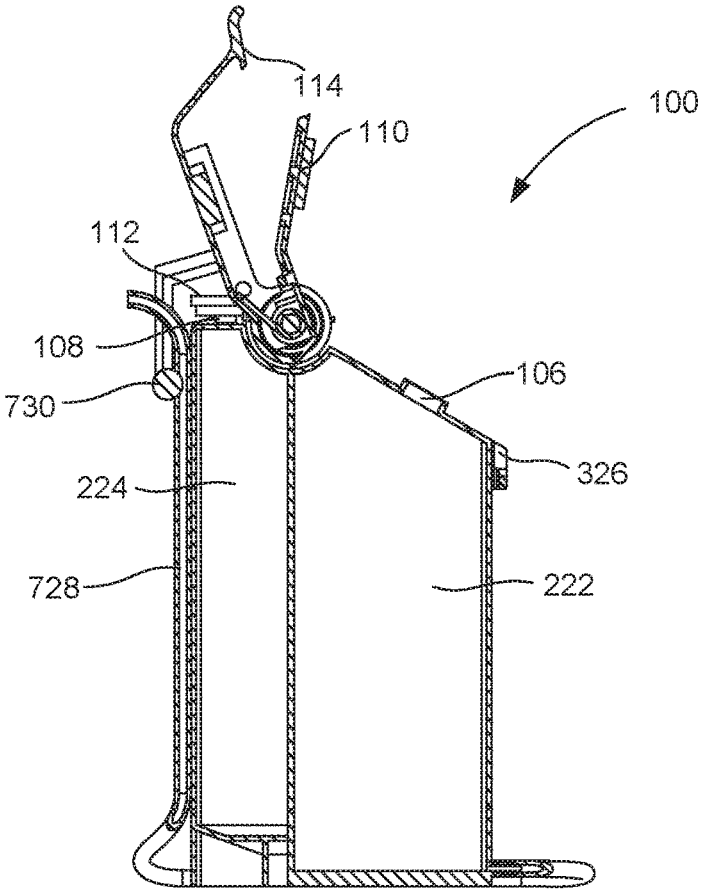

FIGS. 7A-7C are diagrams of a fluid storage device (100) with a multi-position seal assembly (FIG. 1, 104), according to another example of the principles described herein. Specifically, FIG. 7A is an isometric view of the fluid storage device (100) with the seal assembly (FIG. 1, 104) in a second position, FIG. 7B is a front view of the fluid storage device (100) with the seal assembly (FIG. 1, 104) in a second position, and FIG. 7C is a cross sectional view of the fluid storage device (100) taken along the line A-A in FIG. 7B. To dispel fluid from the free fluid chamber (222), the device (100) includes a supply line (728) that is coupled to the free fluid chamber (222) and delivers the fluid, such as ink, to a printhead.

As described above, during refilling, or when the seal assembly (FIG. 1, 104) is in the second position, the air vent (108) is sealed and the refill port (106) is open. As the fluid level rises during refilling of the fluid into the free fluid chamber (222), the fluid level could rise above the level of the printhead nozzle height. As the fluid level in the free fluid chamber (222) rises above the nozzle height, a positive pressure results, i.e., a pressure greater than atmospheric. This positive pressure tends to push fluid out of the free fluid chamber (222). As the overflow chamber (224) is enclosed such that no fluid can pass that way, the fluid tends to flow through the supply line (728), which could lead to leakage out the printhead nozzles, depending on the amount of pressure.

Accordingly, in some examples, a pinching device (730) is included to pinch the supply line (728) to further prevent flow of fluid from the supply line (728) towards the system, i.e., printhead. Doing so may prevent such fluid from transmitting to the nozzles and thereby prevents fluid mixing or fluid drooling.

In some examples the pinching device (730) is a component of the seal assembly (FIG. 1, 104) and is actuated along with the seal assembly (FIG. 1, 104). For example, as depicted in FIGS. 7A-7C, the pinching device (730) is included on the seal assembly (FIG. 1, 104). In this example, the pinching device (730) is activated, or pinches the supply line (728), as the seal assembly (FIG. 1, 104) is in the second position. In other positions, i.e., the first position used for example during printing and the intermediate position, the pinching device (730) may be inactive, meaning it is not actively pinching the supply line.

While specific reference is made to a pinching device (730) that is part of the seal assembly (FIG. 1, 104), the pinching device (730) may be a separate component that during refilling pinches the supply line (728) to prevent inadvertent leakage of fluid from the free fluid chamber (222) towards the rest of the system.

Such a fluid reservoir 1) maintains a constant backpressure in the free fluid chamber, even as fluid is being dispersed form the free fluid chamber; 2) allows for refilling of the free fluid chamber, while sealing the overflow chamber such that fluid doesn't unnecessarily drain into the overflow chamber; and 3) improves the simplicity and efficiency of fluid reservoir refilling. However, it is contemplated that the devices disclosed herein may provide useful in addressing other matters and deficiencies in a number of technical areas. Therefore the systems and methods disclosed herein should not be construed as addressing any of the particular matters.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid storage device comprising:
a fluid reservoir to store fluid comprising:
a free fluid chamber; and
an overflow chamber in fluid communication with the free fluid chamber; and
a seal assembly moveable between a first position, an intermediate position, and a second position, wherein the seal assembly comprises:
a refill port cover to move from the first position where the refill port cover is disposed over and covers a refill port of the free fluid chamber, to the second position to open the refill port; and
an air vent cover to move from the first position where the air vent cover exposes an air vent of the overflow chamber to the second position to seal the air vent.

2. The device of claim 1, wherein the fluid is ink.

3. The device of claim 1, wherein the seal assembly moves between the first position and the second position via a single movement.

4. The device of claim 1, wherein when in the intermediate position between the first position and the second position, the seal assembly seals the refill port and seals the air vent.

5. The device of claim 4, wherein the seal assembly is stable when in the first position, the intermediate position, and the second position.

6. The device of claim 1, wherein an actuator of the seal assembly is flush against the fluid reservoir when the seal assembly is in the first position.

7. The device of claim 1, further comprising a retention mechanism disposed on the fluid reservoir to mate with the seal assembly when the seal assembly is in the first position.

8. A method for manufacturing a fluid storage device, the method comprising:
obtaining a seal assembly, the seal assembly comprising:
a refill port cover to cover a refill port of a free fluid chamber of a fluid reservoir when the seal assembly is in a first position and an intermediate position;
an air vent cover to cover an air vent in an overflow chamber of the fluid reservoir when the seal assembly is in the intermediate position and a second position; and
an actuator to rotationally shift both the refill port cover and the air vent cover between the first position, intermediate position, and second position; and
rotationally coupling the seal assembly to the fluid reservoir such that via a single movement, the seal assembly rotates through the first position, the intermediate position, and the second position.

9. The method of claim 8, wherein the actuator is spring-loaded to bias the seal assembly to at least one of the first position, the intermediate position, and the second position.

10. A fluid storage device comprising:
a printing fluid reservoir comprising:
a free fluid chamber to supply a printhead with printing fluid, the free fluid chamber having a refill port through which the free fluid chamber is refilled with printing fluid;
an overflow chamber in fluid communication with the free fluid chamber, the overflow chamber having an air vent;
a seal assembly rotationally coupled to the fluid reservoir and moveable between a first position, an intermediate position, and a second position, the seal assembly comprising:
a refill port cover to rotate from the first position where the refill port cover is disposed over and covers the refill port of the free fluid chamber, to the second position to open the refill port; and
an air vent cover to rotate from the first position where the air vent cover exposes the air vent of the overflow chamber, to the second position to seal the air vent,
wherein the seal assembly, when between the first position, second position, and intermediate position without force, biases towards at least one of the first position, the second position, and the intermediate position.

11. The device of claim 10, wherein the seal assembly:
is in the first position while printing fluid is being deposited on a print media;
is in the intermediate position while transitioning between depositing printing fluid on a print media and refilling the printing fluid reservoir; and
is in the second position while refilling the printing fluid reservoir with printing fluid.

12. The device of claim 10, further comprising a pinching device to pinch a supply line from an outlet of the free fluid chamber when the seal assembly is in the second position.

13. The device of claim 10, wherein the seal assembly rotates through the first position, the intermediate position, and the second position in one motion.

14. The device of claim 10, wherein the seal assembly comprises:
an air vent cover to seal the air vent in the overflow chamber when the seal assembly is in the intermediate position and the second position; and
a refill port cover to seal the refill port in the free fluid chamber when the seal assembly is in the first position and the intermediate position.

15. The device of claim 14, wherein at least one of the air vent cover and the refill port cover include an elastomer to seal at least one of the air vent and the refill port.

16. The device of claim 1, wherein the seal assembly comprises:

an air vent cover to, during refilling, seal the air vent in the overflow chamber; and a refill port cover to, during printing, seal the refill port in the free fluid chamber.

17. The device of claim 1, wherein the seal assembly comprises multiple springs to bias the seal assembly in the first position and the second position.

18. The device of claim 1, wherein the seal assembly is to prevent the refill port and air port from being exposed to atmospheric pressure at the same time.

19. The device of claim 10, wherein the seal assembly is stable when in the first position and the second position.

20. The device of claim 10, wherein the storage wherein the fluid storage device is insertable into a printing device.

* * * * *